US009285095B2

(12) United States Patent
Chen et al.

(10) Patent No.: US 9,285,095 B2
(45) Date of Patent: Mar. 15, 2016

(54) COMBINATION TYPE ILLUMINATION APPARATUS

(75) Inventors: Ming-Yun Chen, Dong Guan (CN); Zuo-Cai Hong, Dong Guan (CN)

(73) Assignee: LivingStyle Enterprises Limited, Dong Guan (CN)

( * ) Notice: Subject to any disclaimer, the term of this patent is extended or adjusted under 35 U.S.C. 154(b) by 318 days.

(21) Appl. No.: 14/126,378

(22) PCT Filed: Jun. 14, 2012

(86) PCT No.: PCT/CN2012/076938

§ 371 (c)(1),
(2), (4) Date: Dec. 13, 2013

(87) PCT Pub. No.: WO2012/171468

PCT Pub. Date: Dec. 20, 2012

(65) Prior Publication Data

US 2014/0126220 A1 May 8, 2014

(30) Foreign Application Priority Data

| | | |
|---|---|---|
| Jun. 14, 2011 | (CN) | 2011 2 0199487 U |
| Jun. 14, 2011 | (CN) | 2011 2 0199522 U |
| Jun. 14, 2011 | (CN) | 2011 2 0199523 U |
| Jun. 14, 2011 | (CN) | 2011 2 0199524 U |
| Jun. 14, 2011 | (CN) | 2011 2 0199525 U |

(51) Int. Cl.
*F21V 1/14* (2006.01)
*F21K 99/00* (2010.01)
(Continued)

(52) U.S. Cl.
CPC ..... *F21V 1/146* (2013.01); *F21K 9/1355* (2013.01); *F21V 17/164* (2013.01); *F21V 3/02* (2013.01);
(Continued)

(58) Field of Classification Search
CPC ..... F21V 17/16; F21V 17/164; F21V 5/00; F21V 23/0464; F21V 23/0457; F21V 23/007; F21V 23/006; F21V 23/002; F21V 23/003; F21V 23/004; F21V 23/005; F21V 23/02; F21V 29/004; F21V 29/506; F21V 29/74; F21Y 2103/022; F21Y 2101/02
See application file for complete search history.

(56) References Cited

U.S. PATENT DOCUMENTS 3,781,538 A * 12/1973 Brudy ..... B60Q 1/2611 340/471

(Continued)

FOREIGN PATENT DOCUMENTS

| | | |
|---|---|---|
| CN | 101680613 | 3/2010 |
| CN | 201420982 | 3/2010 |

(Continued)

*Primary Examiner* — Hargobind S Sawhney
(74) *Attorney, Agent, or Firm* — Kirton McConkie; Evan R. Witt

(57) ABSTRACT

The present invention relates to a combination type illumination apparatus that includes a lamp body, a lamp cap module and a LED light emitting module. The LED light emitting module is disposed on the lamp body. The lamp body has an accommodation hole and a center sleeve stored in the accommodation hole. The center sleeve includes a first joggle structure. The lamp cap module includes a second joggle structure. The second joggle structure of the lamp cap module is assembled to the first joggle structure of the center sleeve. With such structure configuration, manufacturers may assemble the combination type illumination apparatus in a joggling way instead of in a screwing or gluing method.

15 Claims, 11 Drawing Sheets

(51) Int. Cl.

| | |
|---|---|
| ***F21V 17/16*** | (2006.01) |
| *F21V 3/02* | (2006.01) |
| *F21V 23/04* | (2006.01) |
| *F21Y 101/02* | (2006.01) |
| *F21V 23/00* | (2015.01) |
| *F21Y 103/02* | (2006.01) |
| *F21V 29/77* | (2015.01) |

(52) U.S. Cl.
CPC ..... *F21V 23/002* (2013.01); *F21V 23/006* (2013.01); *F21V 23/0442* (2013.01); *F21V 23/0471* (2013.01); *F21V 29/773* (2015.01); *F21Y 2101/02* (2013.01); *F21Y 2103/022* (2013.01)

(56) References Cited

U.S. PATENT DOCUMENTS 5,577,835 A * 11/1996 Huang ..... F21V 19/0095 362/216
2011/0291560 A1* 12/2011 Wang ..... F21K 9/135 315/32
2012/0112615 A1* 5/2012 Kuenzler ..... F21K 9/135 313/46
2012/0139403 A1* 6/2012 Johnston ..... F21K 9/135 313/46

FOREIGN PATENT DOCUMENTS

| | | |
|---|---|---|
| CN | 201535459 | 7/2010 |
| CN | 201706279 | 1/2011 |
| CN | 201706282 | 1/2011 |
| CN | 201787542 | 4/2011 |
| CN | 102062315 | 5/2011 |
| CN | 202118607 | 1/2012 |
| CN | 202118609 | 1/2012 |
| CN | 202118610 | 1/2012 |
| CN | 202140839 | 2/2012 |
| CN | 202165851 | 3/2012 |

* cited by examiner

COMBINATION TYPE ILLUMINATION APPARATUS

FIELD OF INVENTION

The present invention relates to illumination technique and more particularly relates to a combination type illumination apparatus using joggle structures.

BACKGROUND

A conventional bulb usually at least has a lamp shade, a lamp body, a lamp cap and a light emitting module. A multi-function bulb even has more components. Generally, components in a bulb are connected by screws or glue. However, components in a bulb are small units and are not easily connected with screws or glue. Therefore, assembling takes lots of time and causes low manufacturing efficiency.

Besides, when a bulb is used for a period of time and generates high heat, glue in the bulb may be melt and change shape. Components fixed by the glue therefore may be moved or damaged, causing low product reliability.

In light of this, it is beneficial to provide an illumination apparatus that eliminates use of screws or glue and saves time on assembling.

SUMMARY OF INVENTION

A major objective of the present invention is to provide a combination type illumination apparatus so that assemblers may use joggle structures on light bodies and lamp cap modules to assemble the light bodies with the lamp cap modules so as to simplify assembling, increase assembling efficiency and increase product reliability.

Another objective of the present invention is to provide a combination type illumination apparatus so that assemblers may use joggle structures on light bodies and sensor modules to assemble the light bodies with the sensor modules so as to increase assembling efficiency and increase product reliability.

To achieve the above mentioned objectives, an embodiment of the present invention is to provide a combination type illumination apparatus that includes a lamp body having an accommodation hole and a center sleeve disposed in the accommodation hole. The center sleeve has a first joggle structure. The combination type illumination apparatus also includes a lamp cap module having a second joggle structure, and includes a LED light emitting module disposed on the lamp body. The second joggle structure of the lamp cap module and the first joggle structure of the center sleeve are connected to each other. Preferably, the combination type illumination apparatus further includes a transparent lamp shade which covers the light emitting module and is connected to the lamp body.

Preferably, the lamp body includes a lamp cup. The inner surface of the lamp cup defines the accommodation hole. The center sleeve is disposed through the accommodation hole. One end of the center sleeve is formed the first joggle structure to be connected to the second joggle structure of the lamp cap module. The first joggle structure is a joggle slot and the second joggle structure is a joggle block. The joggle block is hooked in the joggle slot.

Preferably, the above mentioned combination type illumination apparatus further includes a sensor and driver module. The sensor and driver module includes a first circuit board, a sensor device, a driver integrated circuit chip and a transformer. The sensor device, the driver integrated circuit chip and the transformer are disposed on the first circuit board. At least a portion of the first circuit board is disposed through the center sleeve.

Preferably, the lamp body further includes a heat dissipation block. Two ends of the heat dissipation block respectively touch the inner surface of the lamp cup and the driver integrated circuit chip and/or the transformer on the first circuit board.

Preferably, there is a through hole at a lateral side of the center sleeve so as to dispose the heat dissipation block.

Preferably, the lamp body further includes a silicon gasket. The silicon gasket is clipped between the heat dissipation block and the driver integrated circuit chip, and/or the silicon gasket is clipped between the heat dissipation block and the transformer.

Preferably, the center sleeve has a third joggle structure. The sensor and driver module further includes a bonding component that has a fourth joggle structure. The fourth joggle structure of the bonding component is assembled to the third joggle structure of the center sleeve. When the sensor device is a microwave sensor component, the bonding component is assembled to the sensor device. Alternatively, when the sensor device is a passive infrared sensor component, the sensor and driver module further includes a glare shield and the bonding component is assembled to the glare shield.

Preferably, the third joggle structure is formed at the other end opposite to the end of the center sleeve so as to assemble to the fourth joggle structure of the bonding component. The third joggle structure is a buckle pin and the fourth joggle structure is a buckle seat. The buckle pin is connected to the buckle seat.

Preferably, the lamp cap module includes a lamp cap inner tube, a conductive outer casing and a conductive component. The conductive outer casing is sleeved on the outer surface of the lamp cap inner tube and the conductive component is plugged in the bottom surface of the lamp cap inner tube.

Preferably, the lamp body further includes a first conductive pin and a second conductive pin. First ends of the first conductive pin and the second conductive pin are respectively electrically connected to the two electrodes of the first circuit board. The conductive outer casing is screwed to the lamp cap inner tube. A second end of the first conductive pin is extended to the gap between the conductive outer casing and the lamp cap inner tube so that the second end of the first conductive pin is electrically connected to the conductive outer casing.

Preferably, the lamp body further includes a first conductive pin and a second conductive pin. First ends of the first conductive pin and the second conductive pin are respectively electrically connected to the two electrodes of the first circuit board. The conductive component is disposed in a connection hole defined by the bottom of the lamp cap inner tube. At least a portion of the conductive component is exposed outside the lamp cap inner tube so that the second end of the second conductive pin is plugged in the connection hole and electrically connected to the conductive component.

Preferably, the light emitting module includes a second circuit board. The height of the vicinity of the center portion of the second circuit board is higher than the height of the vicinity of the edge portion of the second circuit board Preferably, the lamp body further includes an alloy cooling fins of high thermal conductivity. The light emitting module is disposed on the alloy cooling fins of high thermal conductivity.

Another preferred embodiment of the present invention is a combination type illumination apparatus that includes a lamp body having an accommodation hole and a center sleeve stored in the accommodation hole. The center sleeve has a joggle structure. The combination type illumination apparatus also includes a LED light emitting module disposed on the lamp body, and includes a sensor and driver module that has a sensor device and a bonding component. The bonding component has a second joggle structure. The second joggle structure of the bonding component is assembled to the first joggle structure of the center sleeve.

Preferably, the combination type illumination apparatus further includes a transparent lamp shade. The transparent lamp shade covers the light emitting module and is connected to the lamp body.

Preferably, the lamp body includes a lamp cup, the inner surface of the lamp cup defines the accommodation hole. The center sleeve is disposed through the accommodation hole. One end of the center sleeve forms a first joggle structure to assemble to the second joggle structure of the bonding component. When the sensor device is a microwave sensor component, the bonding component is combined to the sensor device. Alternatively, when the sensor device is a passive infrared sensor component, the sensor and driver module further includes a glare shield. The bonding component is combined to the glare shield. The first joggle structure is a buckle pin and the second joggle structure is a buckle seat. The buckle pin is connected to the buckle seat.

Preferably, the combination type illumination apparatus further includes a lamp cap module. The center sleeve has a third joggle structure and the lamp cap module has a fourth joggle structure. The fourth joggle structure of the lamp cap module and the third joggle structure of the lamp body are hooked to each other.

Preferably, the third joggle structure is formed at a other end opposite to the end of the center sleeve so as to connect to the fourth joggle structure of the lamp cap module. The third joggle structure is a joggle slot and the fourth joggle structure is a joggle block. The joggle block is connected to the joggle slot.

Another preferred embodiment is a combination type illumination apparatus that includes a lamp body having an accommodation hole and a center sleeve stored in the accommodation hole. The center sleeve has a first joggle structure and a second joggle structure respectively disposed at two opposite ends of the center sleeve. The combination type illumination apparatus further includes a LED light emitting module disposed on the lamp body, and includes a sensor and driver module having a sensor device and a bonding component. The bonding component has a third joggle structure to assemble to the first joggle structure. The combination type illumination apparatus also includes a lamp cap module having a fourth joggle structure to connect to the second joggle structure.

By using the joggle structures formed on the lamp body, the lamp cap module, and/or the sensor and driver module, assemblers can easily assemble the lamp body, the lamp cap module and/or the sensor and driver module without screws or glue. This is easy and provides high assembling efficiency. Manufacturing time is short and product reliability is increased.

DETAILED DESCRIPTION

Figure 1:
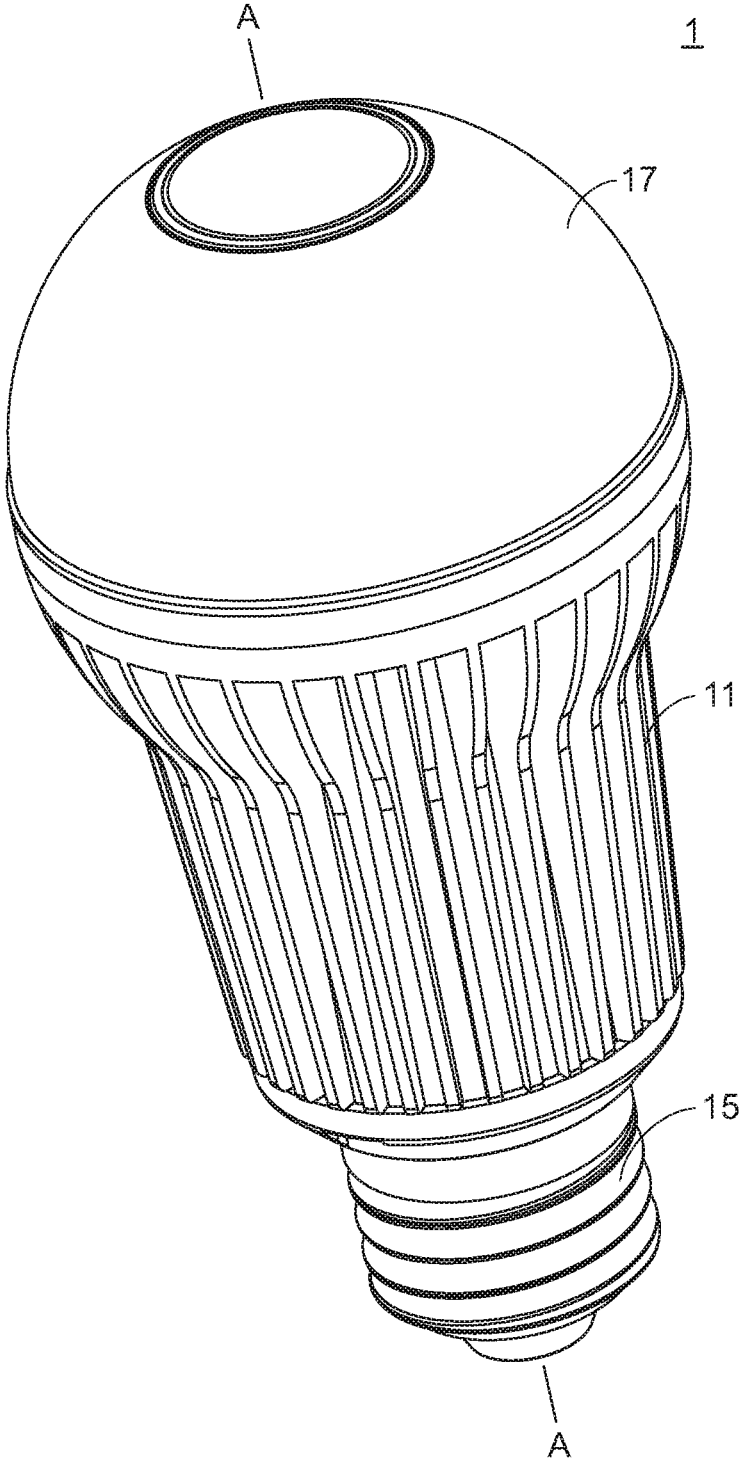
FIG. 1 is a perspective view of a combination type illumination apparatus of the present invention.
Figure 2:
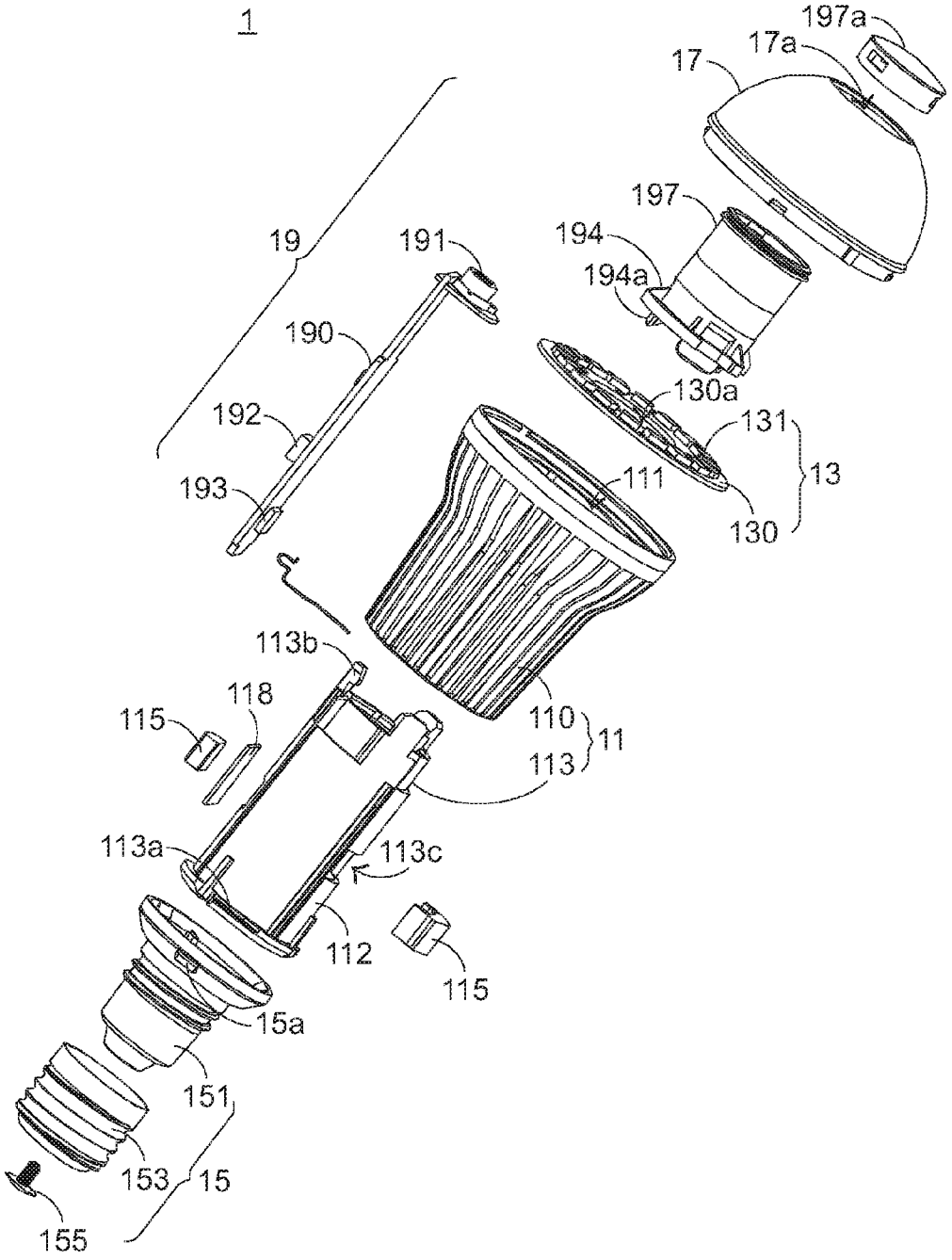
FIG. 2 is an overall perspective exploded view of a first embodiment of the combination type illumination apparatus of the present invention.

Please refer to FIG. 1 and FIG. 2. FIG. 1 is a perspective diagram of a combination type illumination apparatus according to the present invention. FIG. 2 is an overall perspective exploded diagram of a first embodiment of the combination illumination type illumination apparatus according to the present invention. The combination type illumination apparatus 1 of the present invention includes a lamp body 11, a lamp cap module 15, a LED light emitting module 13 and a transparent lamp shade 17. The lamp cap module 15 is disposed at a first end of the lamp body 11. The transparent lamp shade 17 covers the LED light emitting module 13. The transparent lamp shade 17 and the LED light emitting module 13 are disposed at a second end of the lamp body 11. Further, the lamp body 11 includes a lamp cup 110 and a center sleeve 113. The inner surface of the lamp cup 110 defines an accommodation hole 111 for the center sleeve to be disposed therein through.

Figure 3:
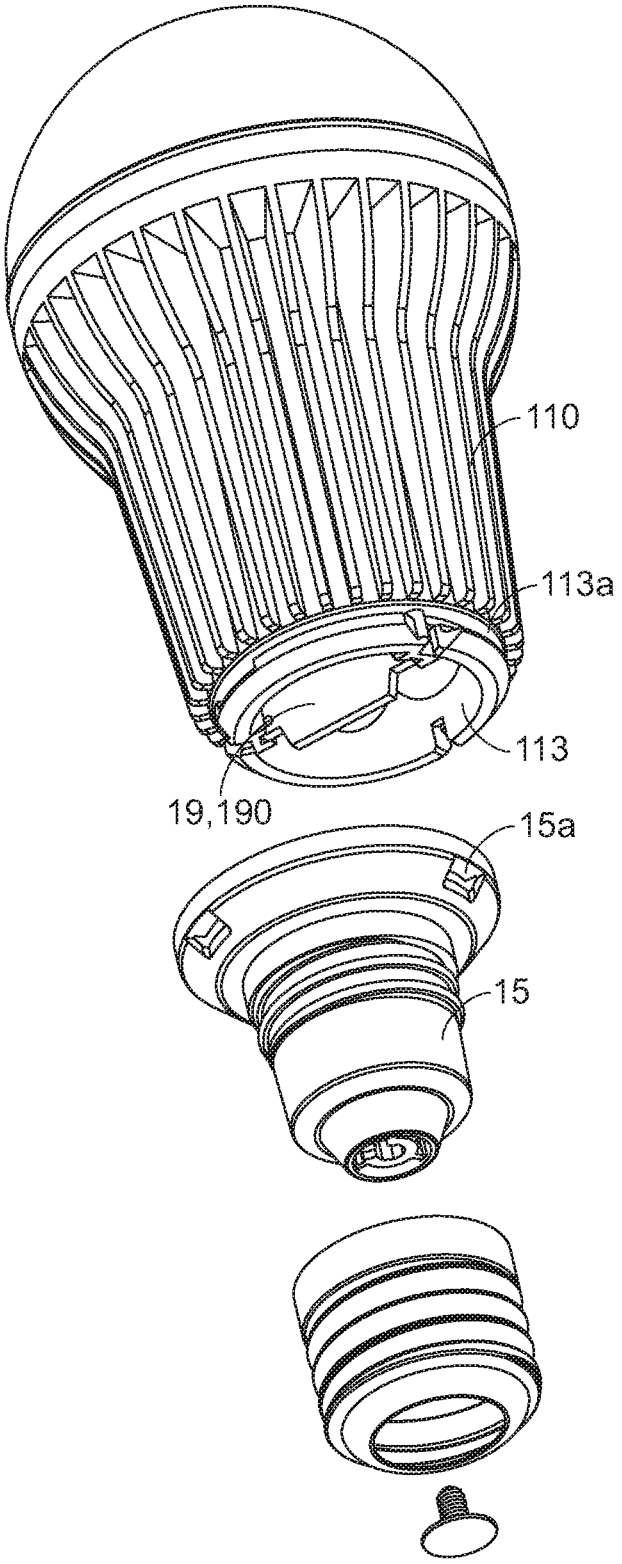
FIG. 3 is a partial perspective exploded view of the first embodiment of the combination type illumination apparatus of the present invention.
Figure 4:
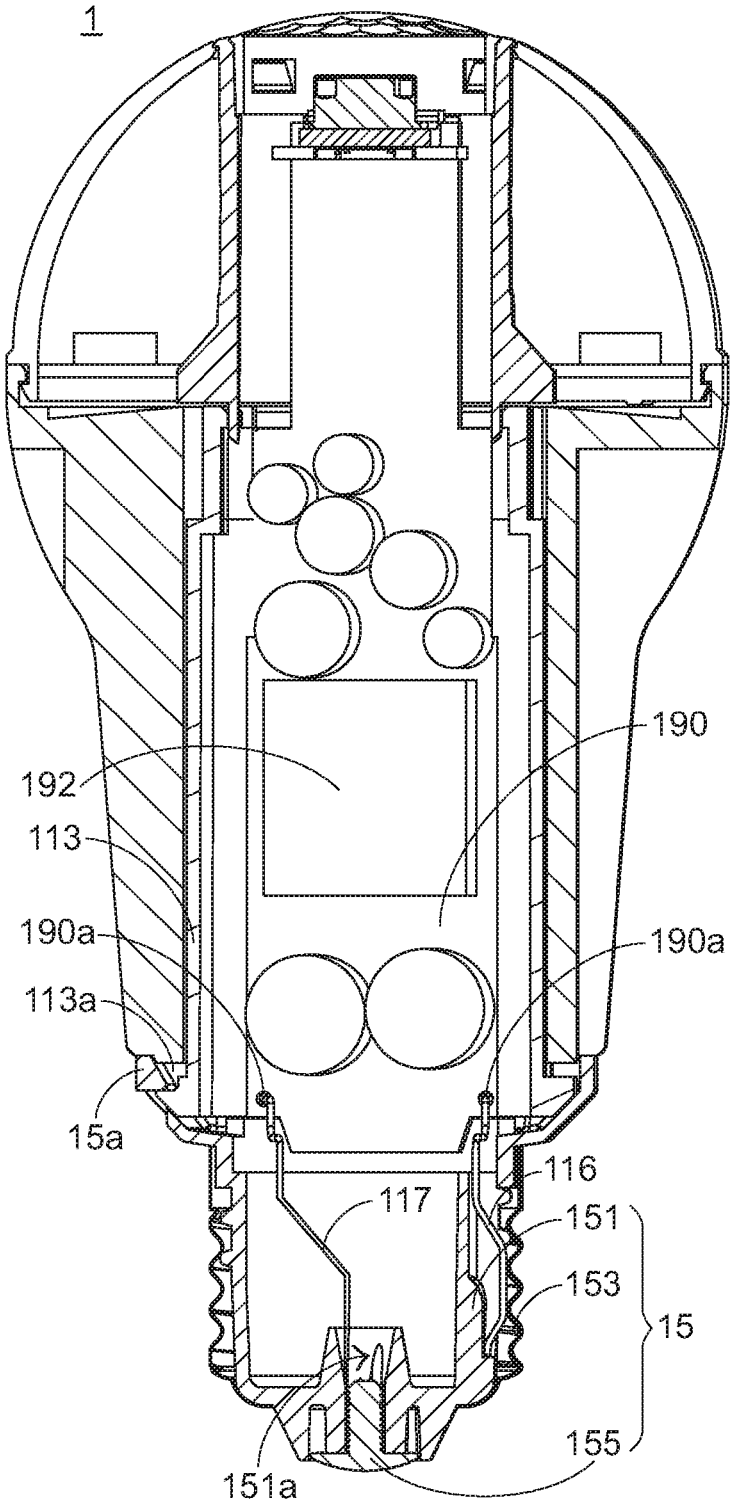
FIG. 4 is a section view of the first embodiment of the combination type illumination apparatus of the present invention cross the A-A axial line.
Figure 5:
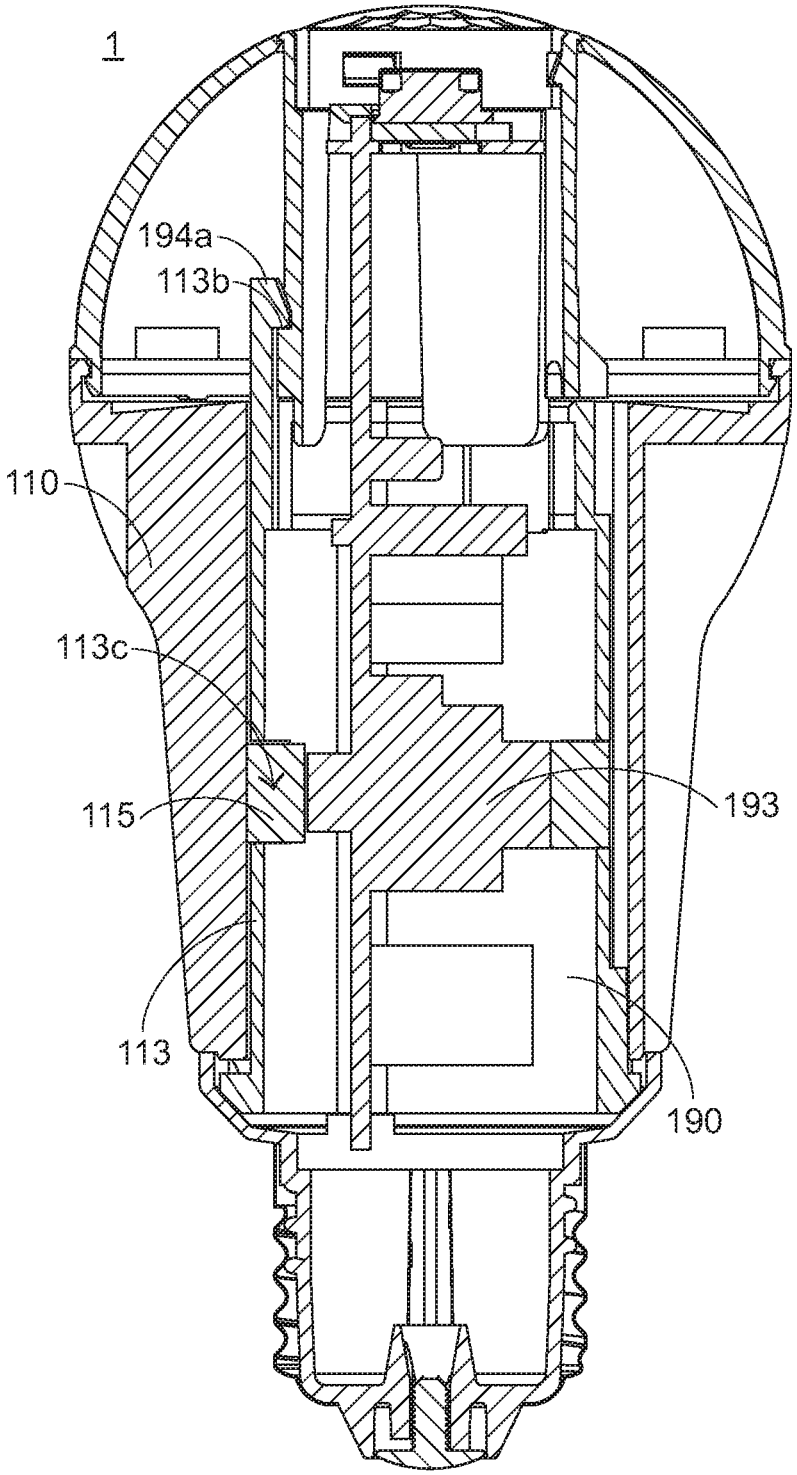
FIG. 5 is a section view of the first embodiment of the combination type illumination apparatus of the present invention cross A-A axial line in another direction.

FIG. 3 is a partial perspective exploded view of the first embodiment of the combination type illumination apparatus of the present invention. FIG. 4 is a section view of the first embodiment of the combination type illumination apparatus of the present invention cross the A-A axial line. FIG. 5 is a section view of the first embodiment of the combination type illumination apparatus of the present invention cross A-A axial line in another direction. Please refer FIGS. 1 to 5 together. The center sleeve 113 has a first joggle structure 113*a*. The lamp cap module 15 has a second joggle structure 15*a*. The first joggle structure 113*a* and the second joggle structure 15*a* match each other. For example, in this embodiment, the first joggle structure 113*a* of the center sleeve 113 is a joggle slot, and the second joggle structure 15*a* of the lamp cap module 15 is a joggle block. When an assembler wants to assemble the lamp cap module 15 to the lamp body 11, the assembler only needs to easily press the lamp cap module 15 or the lamp body 11 to joggle the second joggle structure 15*a* of the lamp cap module 15 to the first joggle structure 113*a* of the center sleeve 113 of the lamp body 11 to complete combination.

In the above description, the first joggle structure 113 is a joggle slot, and the second joggle structure 15*a* is a joggle block. But these descriptions are only for explanation instead of limitation.

Besides, the combination type illumination apparatus 1 of the present invention further includes a sensor and driver module 19. The sensor and driver module 19 includes a first circuit board 190, a sensor device 191, a driver integrated circuit chip 192, a transformer 193 and a bonding component 194. The sensor device 191, the driver integrated circuit chip 192 and the transformer 193 are disposed on the first circuit board 190. At least a portion of the first circuit board 190 is disposed through the center sleeve 113. Such configuration avoids assembling limitation due to the size of the first circuit board 190. Consequently, space utilization is significantly increased so as to achieve higher flexibility of component installation.

As mentioned above, the center sleeve 113 has a first joggle structure 113*a* to be combined to the second joggle structure 15*a* of the lamp cap module 15. Besides, the center sleeve 113 further includes a third joggle structure 113*b*. Preferably, the third joggle structure 113*b* and the first joggle structure 113*a* are disposed at two opposite ends of the center sleeve 113. Moreover, the bonding component 194 has a fourth joggle structure 194*a*. The fourth joggle structure 194*a* of bonding component 194 is combined with the third joggle structure 113*a* of the center sleeve 113.

Please be notated that two different sensor devices are used for explanation in the following description. In the first sensor device embodiment, the sensor device 191 is a passive infrared sensor component. In the second sensor device embodiment, the sensor device 191 is a microwave sensor component.

Figure 6:
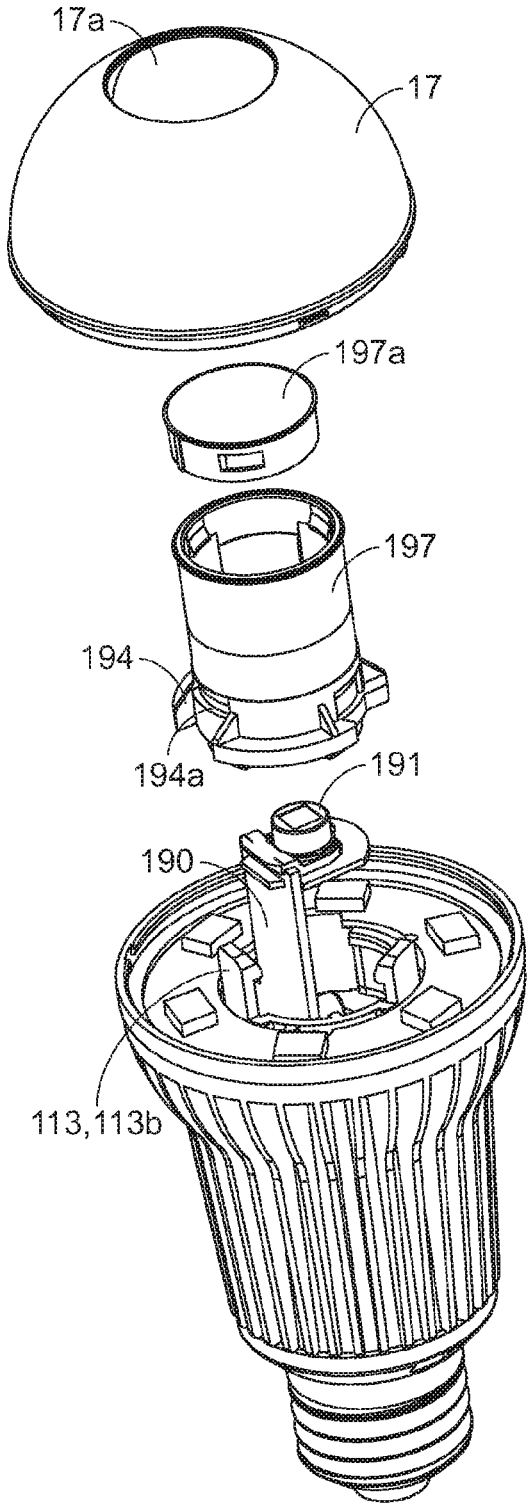
FIG. 6 is another partial perspective exploded view of the first embodiment of the combination type illumination apparatus of the present invention.

FIG. 6 is another partial exploded view of the first embodiment of the combination type illumination apparatus of the present invention. Please refer to FIGS. 2 to 6. In the first embodiment of the present invention, the sensor device 191 is a passive infrared sensor component. In such case, the sensor and driver module 19 further includes a glare shield 197. The glare shield surrounds and shields the passive infrared sensor device 191 to prevent the passive infrared sensor device 191 from being interfered by the light or heat of the light emitting module 13. For installing the glare shield 197, the top of the transparent lamp shade 17 has an opening hole 17*a* on the top. The glare shield 197 is disposed through the opening hole 17*a* to obtain better detection view. There is a lens 197*a* disposed on the top of the glare shield 197.

The glare shield 197 may be combined with the bonding component 194, or may be integrated with the bonding component 194 as illustrated in the embodiment. The fourth joggle structure 194*a* of the bonding component 194 and the third joggle structure 113*a* of the center sleeve 113 of the lamp body are connected together so that the glare shield 197 is connected to the center sleeve 113 with the bonding component 194. In this embodiment, the third joggle structure 113*b* is a buckle pin and the fourth joggle structure 194*a* is a buckle seat. An assembler may easily clip the buckle pin to the buckle seat easily by applying a pushing action.

Please be noted that the configuration that the third joggle structure 113 is a buckle pin and the fourth joggle structure 194*a* is a buckle seat is only for explanation instead of limitation.

The following description explains heat dissipation of the combination type illumination apparatus 1 of the present invention. Please refer to FIG. 2, FIG. 4 and FIG. 5. There are multiple cooling fins surrounding the outside surface of the lamp cup 110, and the lamp cup 110 is preferably made of metal material. Heat conduction is used for helping dissipate heat. Further, the lamp body 11 further includes heat dissipation block 115. Two ends of the heat dissipation block 115 respectively touch the inner surface of the lamp cup 110 and the driver integrated circuit chip 192 and/or the transformer 193 to help the driver integrated circuit chip 192 and the transformer 193 to dissipate heat. Because the center sleeve 113 surrounds the first circuit board 190, the lateral side of the center sleeve 113 is preferably disposed with at least one through hole 113*c* for the heat dissipation block 115 to be disposed through the through hole 113*c* so that two ends of the heat dissipation block 115 respectively touch the lamp cup 110 and the driver integrated circuit chip 192 and/or the transformer 193. In addition, the lamp body 11 may further includes a silicon gasket 118. The heat dissipation block 115 indirectly touches the components to dissipate heat via the silicon gasket 118. For example, the silicon gasket 118 may be clipped between the heat dissipation block 115 and the driver integrated circuit chip 192 and/or the transformer 193. The silicon gasket 118 is flexible and has high thermal conductivity and therefore may be attached to driver integrated circuit chip 192, the transformer 193 and/or other components.

In this embodiment, the lamp cap module 15 includes a lamp cap inner tube 151, a conductive outer casing 153 and a conductive component 155. The conductive outer casing 153 is sleeved on the outer surface of the lamp cap inner tube 151. The conductive component 155 is plugged at a bottom of the lamp cap inner tube 151. The lamp cap inner tube 151 is made of insulation material. After the conductive outer casing 153 and the conductive component 155 are respectively combined with the lamp cap inner tube 151, the conductive outer casing 153 and the conductive component 155 serve as two electrical connection points to electrically connect to a power source.

Specifically, the lamp body 11 further includes a first conductive pin 116 and a second conductive pin 117. The first ends of the first conductive pin 116 and the second conductive pin 117 are respectively electrically connected to the two electrodes 190*a* of the first circuit board 190.

The following description explains the second ends of the first conductive pin 116 and the second conductive pin 117. Because the conductive outer casing 153 is sleeved in the lamp cap inner tube 151, which means the conductive outer casing 153 serves as an electrical connection point, the second end of the first conductive pin 116 is inserted to the gap between the conductive outer casing 153 and the lamp cap inner tube 151 so that the second end of the first conductive pin 116 is electrically connected to the conductive outer casing 153.

Besides, the conductive component 155 is disposed through a connection hole 151*a* defined by the bottom of the lamp cap inner tube 151 so that at least a portion of the conductive component 155 is exposed outside the lamp cap inner tube 151 to serve as an electrical connection point. With such, the second end of the conductive pin 11 is inserted to the connection hole 151*a* to electrically connect to the conductive component 155.

With the above configuration, the first conductive pin 116 and the second conductive 117 perform electrical connection by respectively touching the conductive outer casing 153 and the conductive component 155. This makes assembling easier. No welding tools are necessary. Manufacturing efficiency is increased and cost is decreased.

Nevertheless, other alternative options may be applied if electrical connection is performed between the first circuit board 190 and the conductive outer casing 153 and the conductive component 155 and they are covered by the scope of the present invention.

Figure 7:
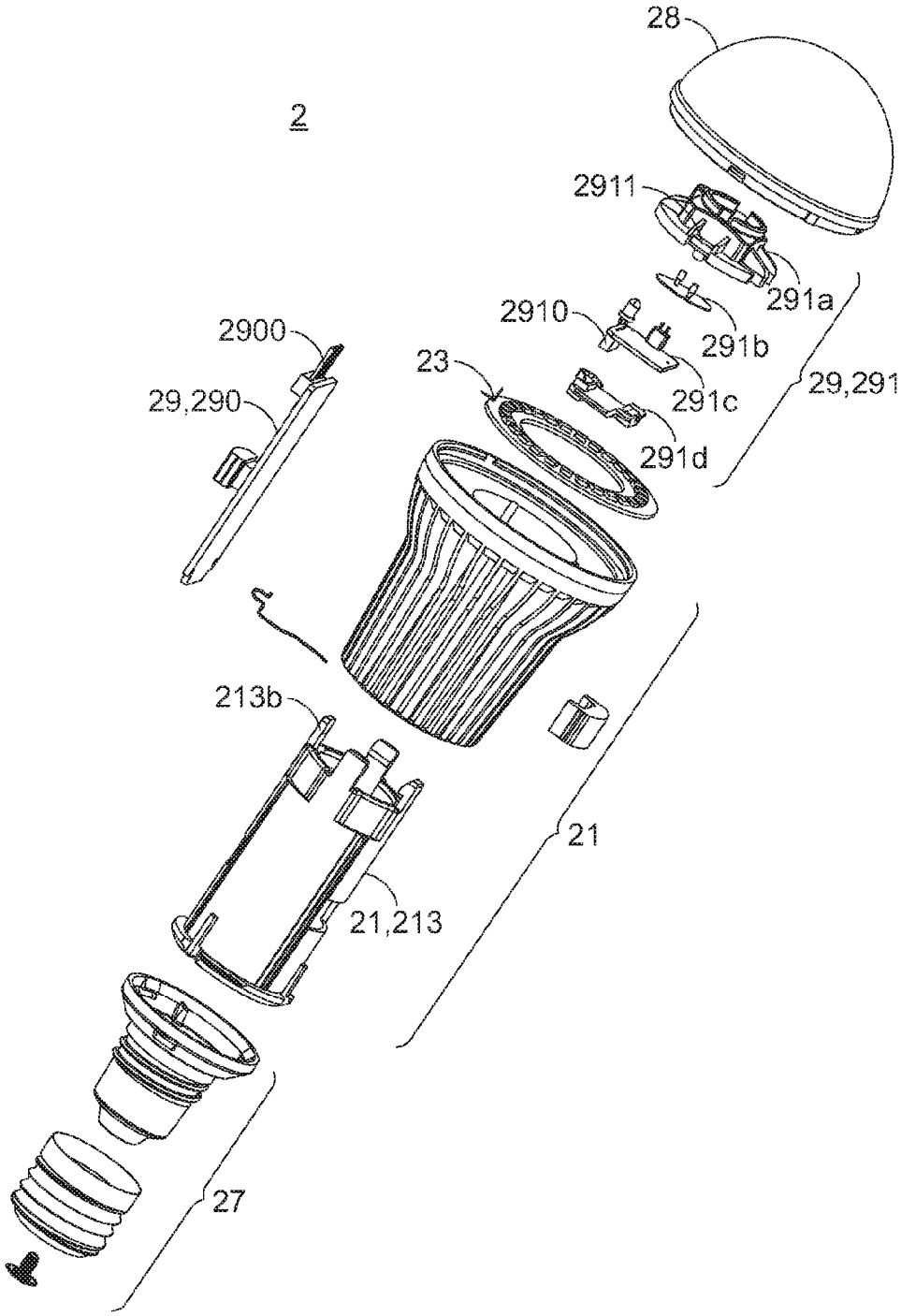
FIG. 7 is an overall perspective exploded view of a second embodiment of the combination type illumination apparatus of the present invention.
Figure 8:
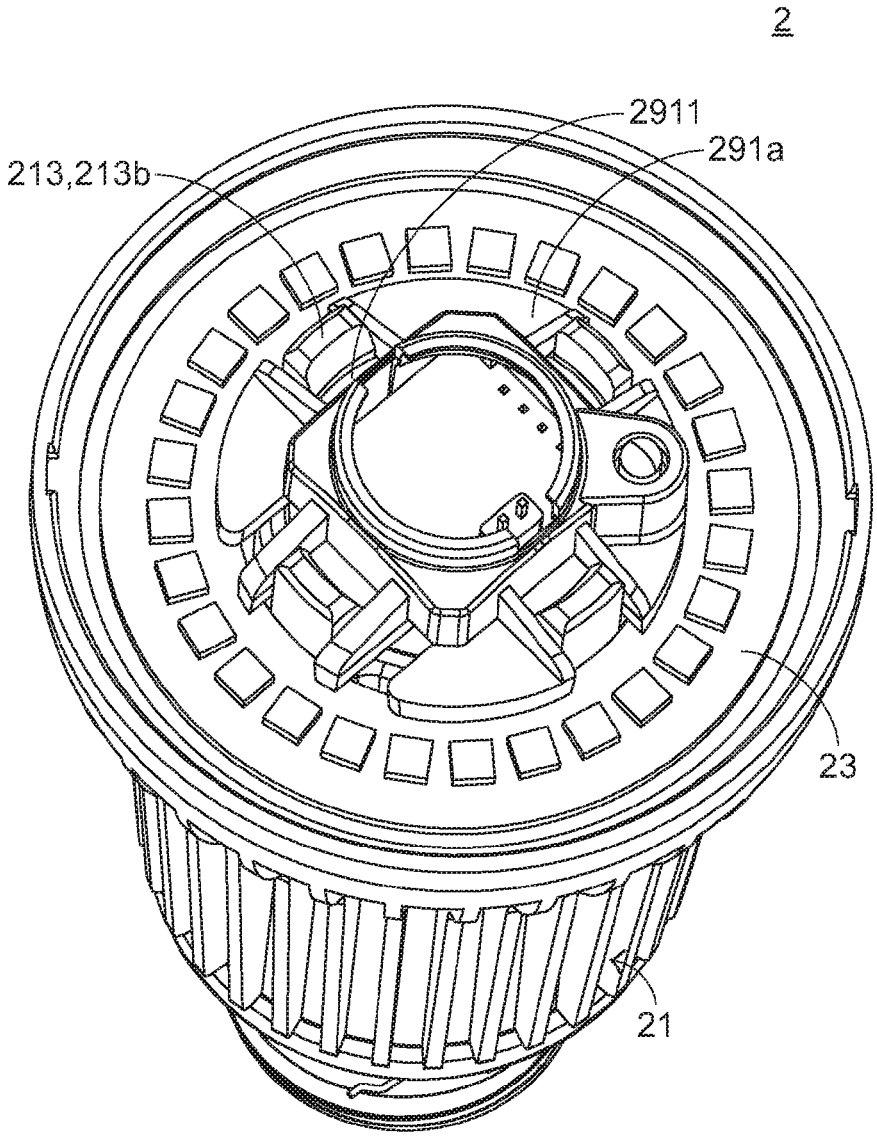
FIG. 8 is a perspective view of the second embodiment of the combination type illumination apparatus of the present invention.

Please refer to FIG. 7, which is a overall exploded vide of the second embodiment of the combination type illumination apparatus of the present invention. FIG. 8 is a perspective view of the second embodiment of the combination type illumination apparatus of the present invention. Please refer to FIG. 7 and FIG. 8 together. In this embodiment, the combination type illumination apparatus 2 includes a lamp body 21, a light emitting module 23, a sensor and river module 29, a lamp cap module 27 and a transparent lamp shade 28. For brevity, because the lamp cap 21, the light emitting module 23 and the lamp cap module 27 have similar structures and functions as mentioned in previous embodiment, they are not explained in details here again.

In this embodiment, the sensor and driver module 29 includes a sensor device 291 and a first circuit board 290. A major difference between this embodiment and previous embodiment is that this embodiment uses a different sensor device 291. Consequently, other components need to be modified in their structures. For example, the first circuit board 290 in this embodiment is a driver circuit board.

Specifically, the sensor device 291 is a microwave sensor component which includes a upper cover casing 291*a*, an antenna module 291*b*, an amplifying circuit board 291*c* and a bottom cover casing 291*d*. The antenna module 291*b* and the amplifying circuit board 291 are connected to each other. The antenna module 291*b* and the amplifying circuit board 291*c* are clipped between the upper cover casing 291*a* and the bottom cover casing 291*d*. Please be noted that the upper cover casing 291*a* is a bonding component.

Next, the electrical connection between the sensor device 291 and the first circuit board 290 is explained. The amplifying circuit board 291*c* of the sensor device 291 has an anode head 2910. The first circuit board 290 has a cathode slot 2900. The anode head 2910 and the cathode slot 2900 match each other so that the amplifying circuit board 291*c* of the sensor device 291 is electrically connected to the first circuit board 290. Such connection method is only an example. Persons skilled in the art may use other clipping or welding ways to perform connection and such methods are still covered by the present invention. With such configuration, the combination type illumination apparatus 2 is capable of detecting whether human walking around to determine whether to turn on or turn off the light emitting module 23 for saving power.

The lamp body 21 of the combination type illumination apparatus 2 includes a center sleeve 213. The upper cover casing 291*a* has a fourth joggle structure 2911 to be combined with the third joggle structure 213*b* of the center sleeve 213 so as to combine the sensor device 291 with the center sleeve 213. Similarly, the third joggle structure 213*b* of the center sleeve 213 and the fourth joggle structure 2911 of the upper cover casing 291*a* respectively have corresponding hook and slot. All alternative ways and structure designs are covered by the present invention.

Figure 9:
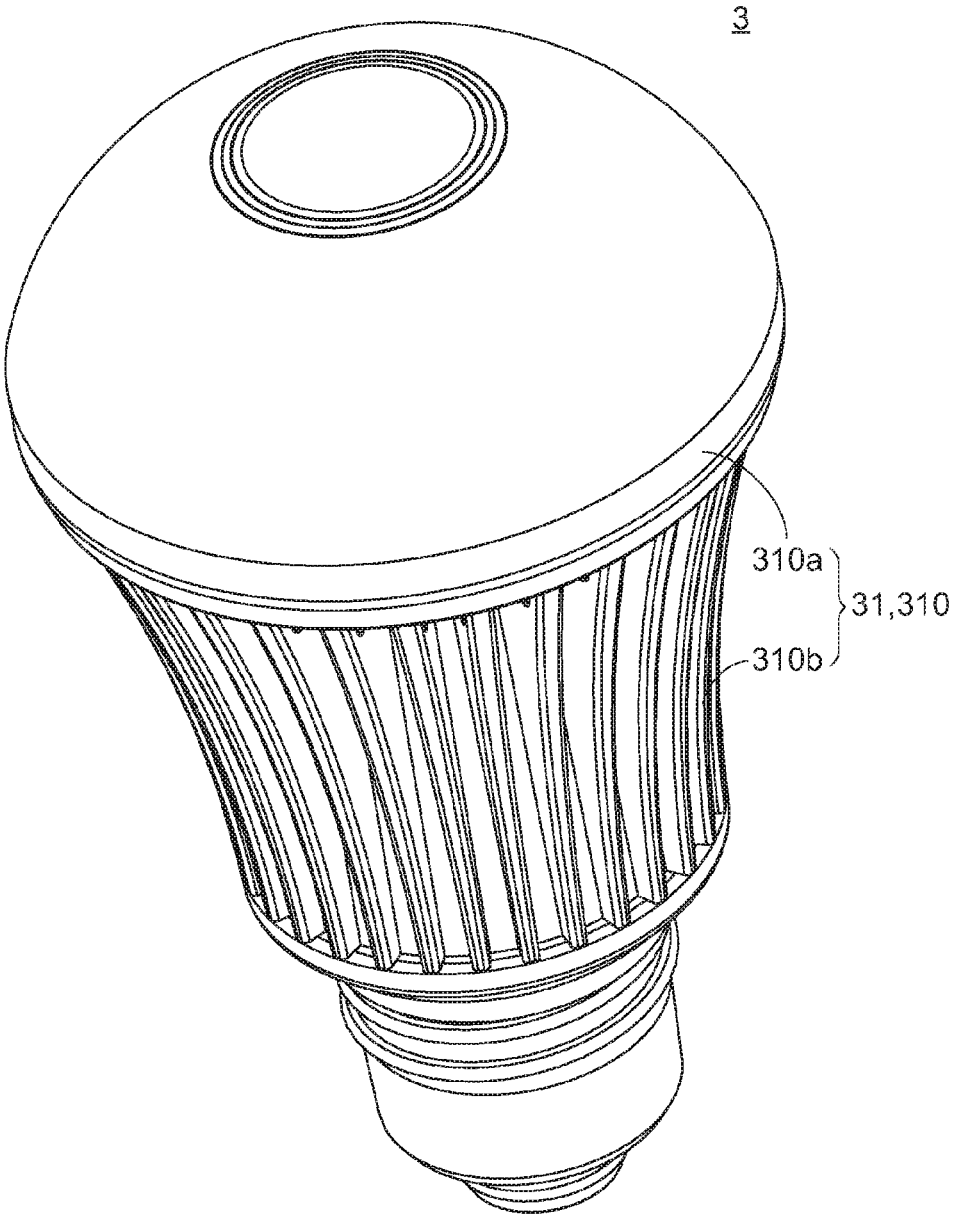
FIG. 9 is a perspective view of a third embodiment of the combination type illumination apparatus of the present invention.
Figure 10:
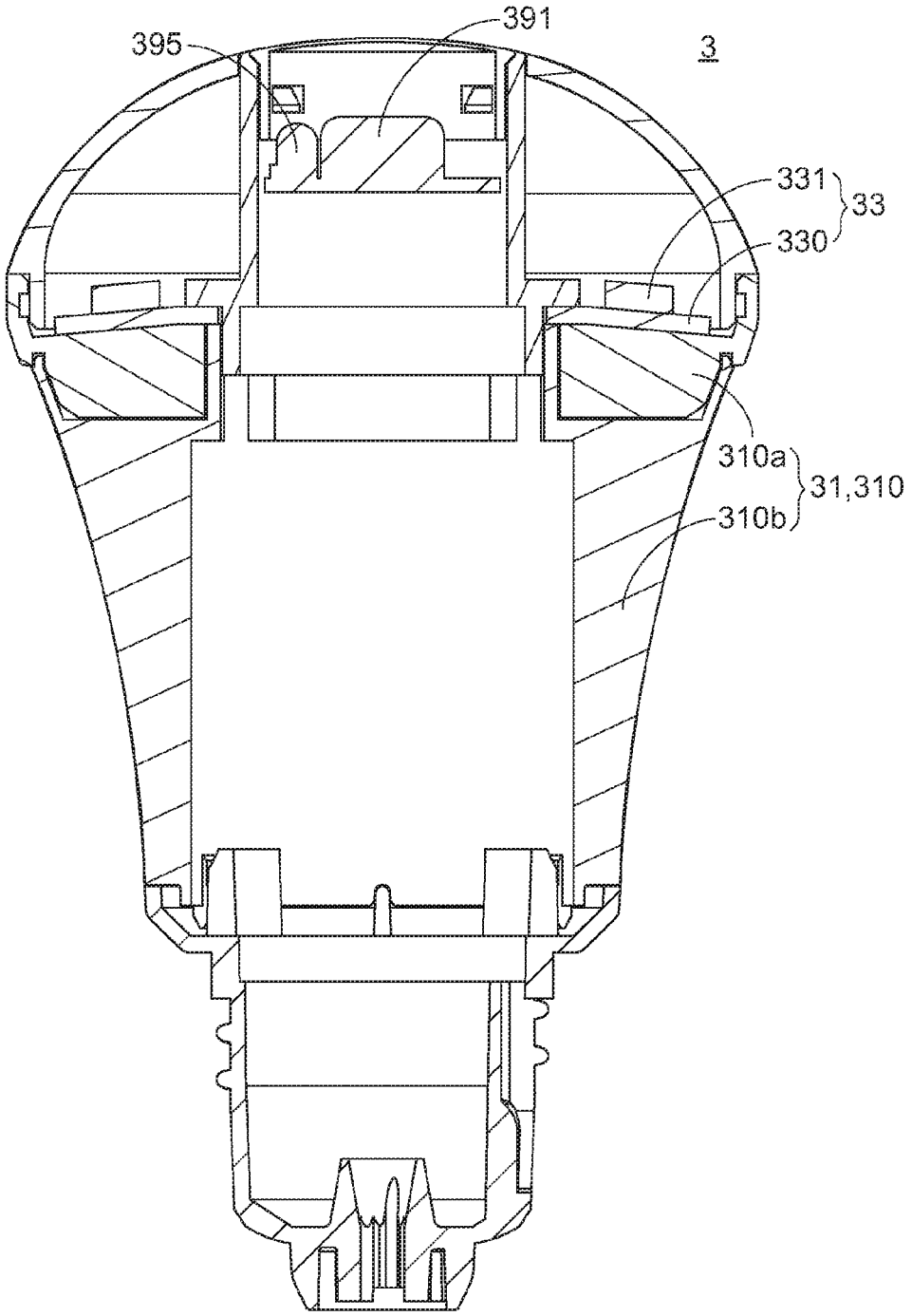
FIG. 10 is a section view of the third embodiment of the combination type illumination apparatus of the present invention.
Figure 11:
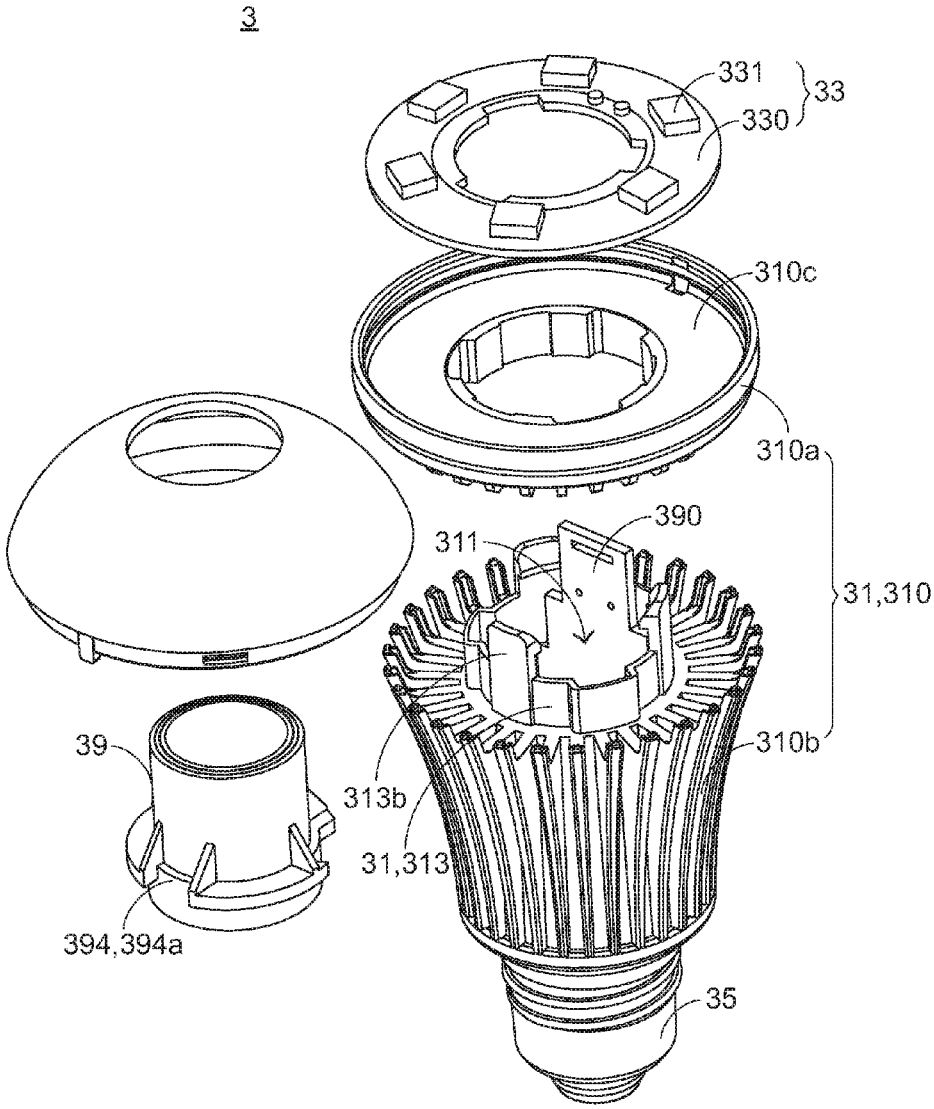
FIG. 11 is an exploded view of the third embodiment of the combination type illumination apparatus of the present invention.

FIG. 9 is a perspective view of a third embodiment of the combination type illumination apparatus. FIG. 10 is a section view of the third embodiment of the illumination apparatus of the present invention. FIG. 11 is an exploded view of the third embodiment of the illumination apparatus of the present invention.

Please refer to FIG. 10. In this embodiment, the combination type illumination apparatus 3 includes a lamp body 31, a LED light emitting module 33 and a sensor and driver module 39. Similar to the configuration of the previous two embodiments, the lamp body 31 of this embodiment has a center sleeve 313 and may be stored in a accommodation hole 311 defined by the lamp body 31. The center sleeve 313 has a first joggle structure 313*b* and a second joggle structure (not shown) respectfully formed at opposite two ends of the center sleeve 313 to separately connect to the third joggle structure 394*a* of the bonding component 394 of the sensor and driver module 39 and the fourth joggle structure (not shown) of the lamp cap module 35.

Further, the LED light emitting module 33 includes a second circuit board 330 disposed with multiple LED light emitting components 331. In addition that the second circuit board 330 is designed with a flat plate, the second circuit board 330 may have a larger height near the center than height near its edge portion. In other words, a height offset may be used to increase the illumination angle range and illumination brightness. This is also a design option. Specifically, the second circuit board 330 has a tilt degree of five upraised from the edge portion to center portion to obtain best illumination range and brightness.

Please refer again to FIG. 9 to FIG. 11. The lamp body includes a lamp cup 310. The lamp cup 310 includes an alloy cooling fins 310 with high thermal conductivity and an aluminum heat dissipation device 310*b*. The alloy cooling fins 310*a* is disposed on top of the aluminum heat dissipation device 310*b*. The aluminum heat dissipation device 310*b* has an look of radial fins set to obtain nice heat dissipation effect. Further, an installation surface 310*c* is formed at the other surface opposing the aluminum heat dissipation device 310*b*. The second circuit board 330 may be disposed on the installation surface 310*c* so that heat of the second circuit board 330 may be rapidly dissipated via heat conduction.

Please be noted that the alloy cooling fins 310*a* and the aluminum heat dissipation device 310*b* may be integrated. Combination type design may alternatively be adopted. Preferably, the alloy cooling fins 310*a* may be an aluminum alloy cooling fins made of aluminum alloy material, a magnesium-lithium alloy cooling fins made of magnesium-lithium material, an aluminum magnesium cooling fins made of aluminum magnesium material, or made of any other alloy material with high thermal conductivity.

In addition, the sensor and driver module 39 of this embodiment may further include a light sensor 395 disposed neighboring to the sensor device 391. The light sensor 395 is used for detecting ambient light to determine whether the environment is under low light and to send signal to the first circuit board 390 to control the LED light emitting components 331 to supplement light.

In summary, the combination type illumination apparatus of the present invention has corresponding joggle structures disposed on the lamp body and the lamp cap module so that assemblers may easily combine the lamp body and the lamp cap module without screws or glue. Such design decreases manufacturing time and increases reliability.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

The invention claimed is:

1. A combination type illumination apparatus, comprising:

a lamp body, having an accommodation hole and a center sleeve disposed in the accommodation hole, wherein the center sleeve has a first joggle structure;

a lamp cap module having a second joggle structure; and a LED light emitting module disposed on the lamp body;

wherein the second joggle structure of the lamp cap module is assembled to the first joggle structure of the center sleeve.

2. The combination type illumination apparatus of claim 1, further comprising a transparent lamp shade, wherein the transparent lamp shade is covering the light emitting module and connected to the lamp body.

3. The combination type illumination apparatus of claim 2, wherein the lamp body comprises a lamp cup, the inner surface of the lamp cup defines the accommodation hole, the center sleeve is disposed through the accommodation hole, and the center sleeve has an end forming the first joggle structure to be assembled to the second joggle structure of the lamp cap module, wherein the first joggle structure is a joggle slot, and the second joggle structure is a joggle block which is engaged with the hook groove.

4. The combination type illumination apparatus of claim 3, further comprising a sensor and driver module, the sensor and driver module comprising a first circuit board, a sensor device, a driver integrated circuit chip and a transformer, and the sensor device, the driver integrated circuit chip and the transformer being disposed on the first circuit board, wherein at least a portion of the first circuit board is disposed through the center sleeve.

5. The combination type illumination apparatus of claim 4, wherein the lamp body further comprising a heat dissipation block, two ends of the heat dissipation block respectively touching the inner surface of the lamp cup and the driver integrated circuit chip and/or the transformer of the first circuit board.

6. The combination type illumination apparatus of claim 5, wherein a lateral side of the center sleeve has a through hole for the heat dissipation block to be installed or wherein the lamp body further comprises a silicon gasket, the silicon gasket is clipped between the heat dissipation block and the driver integrated circuit chip, and/or the silicon gasket is clipped between the head dissipation block and the transformer.

7. The combination type illumination apparatus of claim 6, further comprising a sensor and driver module, the sensor and driver module comprising a first circuit board, a sensor device, a driver integrated circuit chip and a transformer, and the sensor device, the driver integrated circuit chip and the transformer being disposed on the first circuit board, wherein at least a portion of the first circuit board is disposed through the center sleeve, wherein the center sleeve further has a third joggle structure, the sensor and driver module further has a bonding component, the bonding component has a fourth joggle structure, the fourth joggle structure of the bonding component and the third joggle structure of the center sleeve are connected to each other, wherein when the sensor device is a microwave sensor component, the bonding component is assembled to the sensor device, or, when the sensor device is a passive infrared sensor component, the sensor and driver module further includes a glare shield, and the bonding component is assembled to the glare shield, or further comprising a sensor and driver module, the sensor and driver module comprising a first circuit board, a sensor device, a driver integrated circuit chip and a transformer, and the sensor device, the driver integrated circuit chip and the transformer being disposed on the first circuit board, wherein at least a portion of the first circuit board is disposed through the center sleeve, wherein the center sleeve further has a third joggle structure, the sensor and driver module further has a bonding component, the bonding component has a fourth joggle structure, the fourth joggle structure of the bonding component and the third joggle structure of the center sleeve are connected to each other, wherein when the sensor device is a microwave sensor component, the bonding component is assembled to the sensor device, or, when the sensor device is a passive infrared sensor component, the sensor and driver module further includes a glare shield, and the bonding component is assembled to the glare shield, wherein the third joggle structure is formed at an other end opposite to the end of the center sleeve to be assembled to the fourth joggle structure of the bonding component, wherein the third joggle structure is a buckle pin, the fourth joggle structure is a buckle seat, and the buckle pin is hooked to the buckle seat.

8. The combination type illumination apparatus of claim 1, further comprising a sensor and driver module, the sensor and driver module comprising a first circuit board, a sensor device, a driver integrated circuit chip and a transformer, and the sensor device, the driver integrated circuit chip and the transformer being disposed on the first circuit board, wherein at least a portion of the first circuit board is disposed through the center sleeve, wherein the lamp cap module comprises a lamp cap internal tube, a conductive outer casing and a conductive component, the conductive outer casing is sleeved on the outer surface of the lamp cap internal tube and the conductive component is plugged in the bottom surface of the lamp cap internal tube.

9. The combination type illumination apparatus of claim 8, wherein the lamp body further comprises a first conductive pin and a second conductive pin, first ends of the first conductive pin and the second conductive pin are respectively electrically connected to two electrodes of the first circuit board, wherein the conductive outer casing is screwed to the lamp cap internal tube, a second end of the first conductive pin is extending to the gap between the conductive outer casing and the lamp cap internal tube so that the second end of the first conductive pin is electrically connected to the conductive outer casing.

10. The combination type illumination apparatus of claim 8, wherein the lamp body further comprises a first conductive pin and a second conductive pin, first ends of the first conductive pin and the second conductive pin are respectively electrically connected to the two electrodes of the first circuit board, wherein the conductive component is disposed in a connection hole defined by the bottom of the lamp cap internal tube, at least a portion of the conductive component is exposed outside the lamp cap internal tube so that the second end of the second conductive pin is plugged in the connection hole and is electrically connected to the conductive component.

11. The combination type illumination apparatus of claim 1, wherein the light emitting module has a second circuit board, the height of the vicinity of the center portion of the second circuit board is higher than the height of the vicinity of the edge portion of the second circuit board, or wherein the lamp body further comprises an alloy cooling fins of high thermal conductivity, and the light emitting module is disposed on the cooling fins of high thermal conductivity of the lamp body.

12. A combination type illumination apparatus comprising:

a lamp body having an accommodation hole and a center sleeve in the accommodation hole, wherein the center sleeve has a first joggle structure;

a LED light emitting module disposed on the lamp body;

a sensor and driver module comprising a sensor device and a bonding component, the bonding component having a second joggle structure;

wherein the second joggle structure of the bonding component is assembled to the first joggle structure of the center sleeve.

13. The assembly illumination apparatus of claim 12, further comprising a transparent lamp shade, wherein the transparent lamp shade is covering the light emitting module and connected to the lamp body, or further comprising a transparent lamp shade, wherein the transparent lamp shade is covering the light emitting module and connected to the lamp body, wherein the lamp body comprises a lamp cup, the inner surface of the lamp cup defines the accommodation hole, the center sleeve is disposed through the accommodation hole, and one end of the center sleeve forms the first joggle structure to be assembled to the second joggle structure of the bonding component; wherein when the sensor device is a microwave sensor component, the bonding component is combined to the sensor device; or when the sensor device is a passive infrared sensor component, the sensor and driver module further comprises a glare shield and the bonding component is combined to the glare shield, wherein the first joggle structure is a buckle pin, the second joggle structure is a buckle seat, and the buckle pin hooked in the buckle seat.

14. The combination type illumination apparatus of claim 13, further comprising a transparent lamp shade, wherein the transparent lamp shade is covering the light emitting module and connected to the lamp body, wherein the lamp body comprises a lamp cup, the inner surface of the lamp cup defines the accommodation hole, the center sleeve is disposed through the accommodation hole, and one end of the center sleeve forms the first joggle structure to be assembled to the second joggle structure of the bonding component; wherein when the sensor device is a microwave sensor component, the bonding component is combined to the sensor device; or when the sensor device is a passive infrared sensor component, the sensor and driver module further comprises a glare shield and the bonding component is combined to the glare shield, wherein the first joggle structure is a buckle pin, the second joggle structure is a buckle seat, and the buckle pin hooked in the buckle seat, and further comprising a lamp cap module, the center sleeve having a third joggle structure, the lamp cap module having a fourth joggle structure, and the fourth joggle structure of the lamp cap module and the third joggle structure of the lamp body are hooked to each other, or further comprising a transparent lamp shade, wherein the transparent lamp shade is covering the light emitting module and connected to the lamp body, wherein the lamp body comprises a lamp cup, the inner surface of the lamp cup defines the accommodation hole, the center sleeve is disposed through the accommodation hole, and one end of the center sleeve forms the first joggle structure to be assembled to the second joggle structure of the bonding component; wherein when the sensor device is a microwave sensor component, the bonding component is combined to the sensor device; or when the sensor device is a passive infrared sensor component, the sensor and driver module further comprises a glare shield and the bonding component is combined to the glare shield, wherein the first joggle structure is a buckle pin, the second joggle structure is a buckle seat, and the buckle pin hooked in the buckle seat, and further comprising a lamp cap module, the center sleeve having a third joggle structure, the lamp cap module having a fourth joggle structure, and the fourth joggle structure of the lamp cap module and the third joggle structure of the lamp body are hooked to each other, and further comprising a lamp cap module, the center sleeve having a third joggle structure, the lamp cap module having a fourth joggle structure, and the fourth joggle structure of the lamp cap module and the third joggle structure of the lamp body are hooked to each other, wherein the third joggle structure is formed at an other end opposite to the end of the center sleeve to be assembled to the fourth joggle structure of the lamp cap module, wherein the third joggle structure is a joggle slot and the fourth joggle structure is a joggle block, and the joggle block is hooked in the hook groove.

15. A combination type illumination apparatus comprising:

a lamp body having an accommodation hole and a center sleeve disposed in the accommodation hole, wherein the center sleeve has a first joggle structure and a second structure respectively disposed at two opposite ends of the center sleeve;

a LED light emitting module disposed on the lamp body;

a sensor and drive module comprising a sensor device and a bonding component, the bonding component having a third joggle structure to be assembled to the first joggle structure; and a lamp cap module having a fourth joggle structure to be assembled to the second joggle structure.

* * * * *